US009140525B2

(12) United States Patent
Yakoub

(10) Patent No.: US 9,140,525 B2
(45) Date of Patent: Sep. 22, 2015

(54) FOLDABLE SHIELD

(71) Applicant: Saintpro AB, Falun (SE)

(72) Inventor: Raed Roro Yakoub, Falun (SE)

(73) Assignee: SAINTPRO AB, Falun (SE)

( * ) Notice: Subject to any disclaimer, the term of this patent is extended or adjusted under 35 U.S.C. 154(b) by 0 days.

(21) Appl. No.: 14/413,386

(22) PCT Filed: Jul. 9, 2013

(86) PCT No.: PCT/SE2013/050881
§ 371 (c)(1),
(2) Date: Jan. 7, 2015

(87) PCT Pub. No.: WO2014/011108
PCT Pub. Date: Jan. 16, 2014

(65) Prior Publication Data

US 2015/0192393 A1 Jul. 9, 2015

(30) Foreign Application Priority Data

Jul. 9, 2012 (SE) ..... 1200427

(51) Int. Cl.
*F41H 5/02* (2006.01)
*F41H 5/08* (2006.01)

(52) U.S. Cl.
CPC ... *F41H 5/08* (2013.01); *F41H 5/02* (2013.01)

(58) Field of Classification Search
CPC ..... F41H 5/08; F41H 5/02
USPC ..... 89/36.02, 36.05, 36.01; 2/2.5
See application file for complete search history.

(56) References Cited

U.S. PATENT DOCUMENTS 237,611 A * 2/1881 Scheuer ..... 416/73
257,950 A * 5/1882 Jordan ..... 416/73

(Continued)

FOREIGN PATENT DOCUMENTS

GB 2 314 144 12/1997
WO WO 2008/071953 6/2008

OTHER PUBLICATIONS

International Search Report dated Oct. 24, 2013 issued in PCT International Patent Application No. PCT/SE2013/050881, 4 pp.

(Continued)

*Primary Examiner* — Michelle R Clement
(74) *Attorney, Agent, or Firm* — Nixon & Vanderhye P.C.

(57) ABSTRACT

A deployable and foldable shield with improved stability, when it is to protect the carrier against weapons and thrown objects, comprising an elongated base plate having attachment means for attaching the base plate along the forearm of a person, and a plurality of substantially triangular and at least substantially equal-sided shield plates, supported by the base plate, which have a top angle (α) smaller than 40° and are pivotally mounted at a triangle corner enclosing the top angle (α) to a pivot projecting from the base plate, said shield plates forming a stack supported by the base plate when the shield is folded and forming a deployed shield surface supported by the base plate when pivoted away from the base plate. In order to improve the stability of the shield, when it is to protect the carrier against weapons and thrown objects, the shield plates are arranged in two stacks with a respective pivot for mounting and pivoting of the shield plates. The shield plates in one stack are deployed by pivoting in a first direction and those in the other stack by pivoting in the opposite direction, and connecting devices are provided for connecting these two shield plates.

19 Claims, 8 Drawing Sheets

(56) References Cited

U.S. PATENT DOCUMENTS

| | | | | | |
|---|---|---|---|---|---|
| 295,013 | A | * | 3/1884 | Hunter | 89/36.06 |
| 1,385,371 | A | | 3/1884 | Hunter | |
| 490,532 | A | * | 1/1893 | Baer | 416/73 |
| 602,967 | A | * | 4/1898 | Wells | 160/134 |
| 1,151,116 | A | * | 8/1915 | Miesejewski | 89/36.03 |
| 1,218,169 | A | * | 3/1917 | Chalikian | 446/473 |
| 1,277,706 | A | * | 9/1918 | Dorfman | 160/130 |
| 1,279,930 | A | * | 9/1918 | Stroud | 89/36.06 |
| 1,327,339 | A | * | 1/1920 | Logan | 244/121 |
| 1,464,876 | A | * | 8/1923 | King | 160/134 |
| 1,613,364 | A | * | 1/1927 | Thompson | 296/97.8 |
| 2,050,178 | A | | 8/1936 | Hite | |
| 2,153,508 | A | * | 4/1939 | Marchbank | 454/218 |
| 2,306,708 | A | * | 12/1942 | Mendel | 42/106 |
| 2,517,281 | A | * | 8/1950 | Brown | 160/62 |
| 2,560,762 | A | * | 7/1951 | Ghegan | 160/134 |
| 2,858,736 | A | * | 11/1958 | Hendrix | 89/1.1 |
| 2,875,825 | A | | 3/1959 | Soares | |
| 3,649,069 | A | * | 3/1972 | Zip | 296/97.7 |
| 4,358,984 | A | * | 11/1982 | Winblad | 89/36.08 |
| 4,699,195 | A | * | 10/1987 | Lester | 160/134 |
| 4,776,380 | A | * | 10/1988 | Lester | 160/134 |
| 4,861,090 | A | * | 8/1989 | Gavrieli | 160/134 |
| 5,117,889 | A | * | 6/1992 | Coe | 160/134 |
| 5,477,431 | A | * | 12/1995 | Curameng, Jr. | 362/102 |
| 5,584,329 | A | * | 12/1996 | Thomas | 160/134 |
| 5,598,883 | A | * | 2/1997 | Platsis | 160/370.23 |
| 5,967,161 | A | * | 10/1999 | Neal | 135/19.5 |
| 6,526,863 | B2 | * | 3/2003 | Torres | 89/36.05 |
| 6,561,257 | B2 | * | 5/2003 | Huang | 160/370.23 |
| 6,691,762 | B2 | * | 2/2004 | Huang | 160/370.23 |
| 6,905,177 | B1 | * | 6/2005 | Murillo | 301/37.103 |
| 6,976,523 | B2 | * | 12/2005 | Huang | 160/370.23 |
| 7,188,658 | B1 | * | 3/2007 | Nordstrom et al. | 160/84.07 |
| 7,347,670 | B1 | * | 3/2008 | Henderson | 416/70 A |
| 7,464,900 | B2 | * | 12/2008 | Clark et al. | 244/171.7 |
| 7,658,302 | B2 | * | 2/2010 | Berman | 222/79 |
| 7,784,877 | B1 | * | 8/2010 | Castillo et al. | 301/37.104 |
| 8,104,395 | B2 | * | 1/2012 | Ran | 89/36.06 |
| 8,136,568 | B2 | * | 3/2012 | DeBauche | 160/84.07 |
| 8,556,351 | B1 | * | 10/2013 | Uhlin | 301/37.104 |
| 8,939,058 | B1 | * | 1/2015 | Ecalono | 89/36.05 |
| 2001/0009179 | A1 | * | 7/2001 | Huang | 160/370.23 |
| 2002/0124717 | A1 | * | 9/2002 | Torres | 89/36.05 |
| 2006/0143792 | A1 | * | 7/2006 | No | 2/195.2 |
| 2007/0056986 | A1 | * | 3/2007 | Berman | 222/79 |
| 2008/0078884 | A1 | * | 4/2008 | Trabandt et al. | 244/171.7 |
| 2011/0056366 | A1 | * | 3/2011 | Ran | 89/36.06 |
| 2014/0103679 | A1 | * | 4/2014 | You | 296/97.6 |

OTHER PUBLICATIONS

Written Opinion dated Oct. 24, 2013 issued in PCT International Patent Application No. PCT/SE2013/050881, 4 pp.

* cited by examiner

FOLDABLE SHIELD

This application is the U.S. national phase of International Application No. PCT/SE2013/050881 filed Jul. 9, 2013 which designated the U.S. and claims priority to Swedish Patent Application No. 1200427-1 filed Jul. 9, 2012, the entire contents of each of which are hereby incorporated by reference.

TECHNICAL FIELD

The present invention relates to a deployable and foldable shield, comprising an elongated base plate having attachment means for attaching the base plate along the forearm of a person, and a plurality of substantially triangular and at least substantially equal-sided shield plates, supported by the base plate, which have a top angle smaller than 40° and are pivotally mounted at a triangle corner enclosing the top angle to a pivot projecting from the base plate, said shield plates forming a stack supported by the base plate when the shield is folded, and forming a deployed shield surface supported by the base plate when pivoted away from the base plate.

STATE OF THE ART

Such a deployable and foldable shield is previously known through GB 2 314 144 A and is intended to be used by police officers and persons in similar professions in missions where they might need to protect themselves against weapons and thrown objects. One advantage with deployable and foldable shields is that they are not as conspicuous as conventional, large and stiff shields, which have proved to have a potentially provoking effect on crowds when police with such shields have confronted them. In the shield according to GB '144, the shield plates are connected to each other with an elastic material resisting deformation, or with a non-elastic thread, and they lie on top of each other in the stack in a similar way as the folds in the wall of a bellows. The shield plates can be opened out by means of spring force and be held in the deployed position by a catch lever. Even though it is suggested to make the shield surface facing away from the wearer concave, the stability of such a shield design is not fully satisfactory.

Another deployable and foldable shield is disclosed and described in WO 2008/071953 A1. Here, the shield surface suitably consists of two layers of Kevlar® fabric with pockets for wheel spoke-like support members, which are pivotable about a pivot and are suitably constituted of aluminium rods, and which hold the fabric stretched out between them when the shield is deployed. Such a shield may be bullet-proof, but the stability of the shield design is not fully satisfactory here either.

BRIEF ACCOUNT OF THE INVENTION

The object of the present invention is to achieve a deployable and foldable shield with improved stability when it is to protect the carrier against weapons and thrown objects.

This object is achieved by a deployable and foldable shield mentioned in the first paragraph above in that the shield plates, according to the invention, are arranged in two stacks, disposed next to each other on the base plate, with a respective pivot for mounting and pivoting of the shield plates, that the shield plates in one stack are deployed by pivoting in a first direction and the shield plates in the other stack by pivoting in the opposite direction, and that connecting devices are provided for connecting the two uppermost two shield plates of the stacks, preferably edge-to-edge. Such a design is more robust than the previously known ones.

According to a preferred embodiment, the uppermost shield plate in one stack and the uppermost shield plate in the other stack are located in a common plane.

Preferably, the base plate and each shield plate on top thereof in each stack is connected to the next shield plate by means a device that allows relative pivoting of the shield plates in their respective planes but prevents relative movement in a direction perpendicular to these planes. This enables a robust, but still simple design.

Suitably, the device comprises a projecting plug disposed in each shield plate, and an arc-shaped groove, disposed in each adjacent shield plate in the stack and in the base plate, respectively, for receiving the projecting end of the plug, wherein the projecting end and the groove are so designed in relation to each other that the plug is form-fittingly connected to the groove, and the ends of the groove are closed, so that the shield plates have side edge areas overlapping each other also when they are pivoted away from each other to a maximum extent. Such a design is simple and reliable.

Alternatively, or in addition, the device can be designed such that each shield plate has an outer end relative to the associated pivot, said outer ends forming together with an outer end of the base plate located simultaneously a periphery of the shield in deployed position, and that the device comprises an axially projecting flange, disposed on each outer end of the shield plates and having a free end which is folded substantially radially inward, and that the device further comprises a groove, extending along the entire said end of at least all the shield plates in each stack except the uppermost shield plate in the respective stack, and in said end of the base plate, for receiving the substantially radially inwardly folded end of the flange in an adjacent shield plate while forming a tongue and groove connection, which allows pivoting of the shield plates in their respective planes and constitutes a stronger obstacle to relative movement in a direction perpendicular to these planes and increases the stability of the shield edge against attacks with weapons or thrown objects.

In order to further increase the stability of the shield edge against attacks with weapons or thrown objects, it is suitable that the substantially radially inwardly folded end of the flange, and the groove for receiving it, are slightly angled such that they are located in a concave plane when viewed in a direction toward a person carrying the deployed shield strapped to the arm.

Preferably, each shield plate comprises a profile strip, having a substantially H shaped cross-section, attached to said outer end, wherein the H has two upwardly extended arms delimiting between themselves said groove, wherein one arm of the H is slightly elongated upward and then folded to the side and finally folded down for the formation of the inwardly folded end of the flange. The H has two legs forming between themselves a second groove, for receiving an end portion, tapered on both sides, of a plate-shaped portion of the shield plate itself while forming a tongue and groove connection. By using such a profile strip, which is attached to the outer end of the shield plate, the manufacture of the shield plate is simplified.

Suitably, the arc-shaped groove for receiving the projecting end of the plug is located in the radially inwardly folded end of the flange. Furthermore, it is suitable that said one arm of the H, which is slightly elongated upward and then folded to the side and finally folded down for the formation of the inwardly folded end of the flange, is thickened compared to the other arm of the H.

In their most simple embodiment, the shield plates are flat and extend perpendicularly away from the respective pivot, wherein the shield surface is thus flat. However, in order to increase the stability of the shield against attacks with weapons or thrown objects, it may be suitable that the shield is concave when viewed in a direction toward a person carrying the deployed shield strapped to the arm. As used herein, the term "concave" also includes "funnel-shaped".

In order to achieve the desired shape of the shield surface, the shield plates can be slightly curved longitudinally, i.e. in a direction away from the top angle, so that the deployed shield surface becomes concave or convex.

Alternatively, the shield plates in each stack can form an angle smaller or larger than 90° with the respective pivot, so that the deployed shield surface becomes funnel-shaped or (truncated) cone-shaped.

The connecting devices connecting the two shield plates edge-to-edge suitably comprise protrusions disposed along the edge of the uppermost shield plate in one stack, and recesses, corresponding to the protrusions, disposed along the edge of the uppermost shield plate in the other stack. Thereby, the protrusions are preferably disposed on both top side and bottom side of the shield plate for aligning the shield plate with the recesses into a position where the protrusions enter the recesses.

Furthermore, it is suitable that the connecting devices comprise a snap locking means, which locks the uppermost shield plate in one stack to the uppermost shield plate in the other stack when they meet each other when deploying the shield.

The shield plates in the two stacks can be pivoted out manually in order to form the deployed shield. However, in order to enable a rapid deployment of the shield, the shield plates in each stack are preferably spring-loaded so that by actuating a release device, when needed, they can be pivoted out to the deployed position rapidly by the spring force.

Furthermore, as a rule, it is suitable that the shield plates consist of transparent material, preferably polycarbonate, but in some cases it may be required that the shield plates are reinforced with bullet-proofing fabric in order to become bullet-proof.

If so desired, it is also possible to design the shield plates such that they give the deployed shield surface a shape which deviates from a purely circular shape, e.g. an oval shape. For example, the shield plates in the middle of each stack can be successively longer than the other ones in order to provide an oval shield with a greater height than width and thereby an improved protection vertically for the carrier of the shield.

BRIEF DESCRIPTION OF THE ACCOMPANYING DRAWINGS

In the following, the invention will be described more closely with reference to preferred embodiments and the accompanying drawings.

DETAILED DESCRIPTION OF PREFERRED EMBODIMENTS

Figure 1:
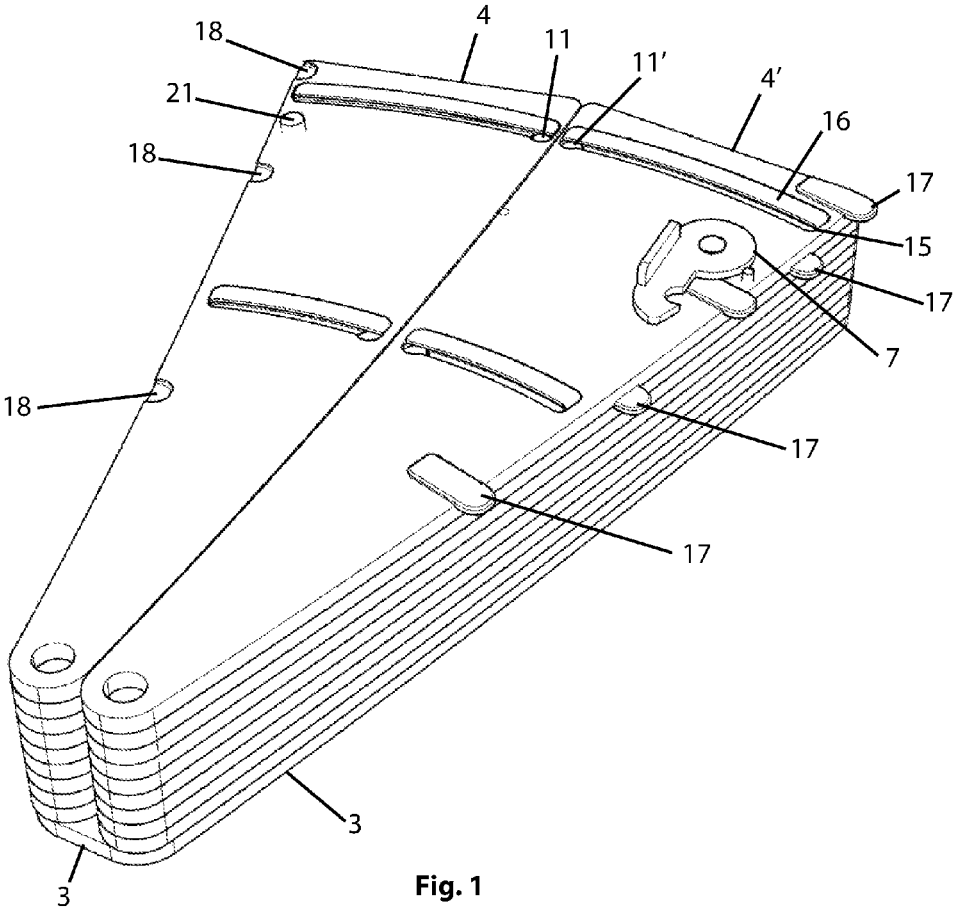
FIG. 1 is a perspective view of a deployable and foldable shield comprising two stacks of folded shield plates, disposed next to each other on a base plate, according to a preferred embodiment of the invention.

The deployable and foldable shield 1 shown in the drawings comprises an elongated base plate 3, which is provided with attachment means well known in this connection for attaching the base plate along the forearm of a person, e.g. by means of hook and loop strips, which are not shown to get better visualization of other parts of the shield 1. A plurality of substantially triangular and at least substantially equal-sided shield plates 4, supported by the base plate 3 and having a top angle $\alpha$ smaller than 40°, are pivotally mounted at a triangle corner enclosing the top angle $\alpha$ to a pivot 5 projecting from the base plate 3. When the shield is folded, the shield plates 4 form a stack 6 supported by the base plate 3, and, when pivoted away from the base plate 3, they form a deployed shield surface 2 supported by the base plate 3.

Figure 2:
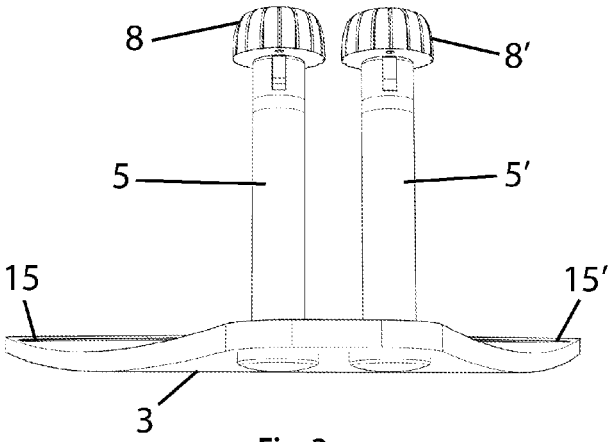
FIG. 2 is an end view of the base plate in FIG. 1 with two screw-nut assemblies which retain the shield plates in the two stacks but allow pivoting of the shield plates.
Figure 3:
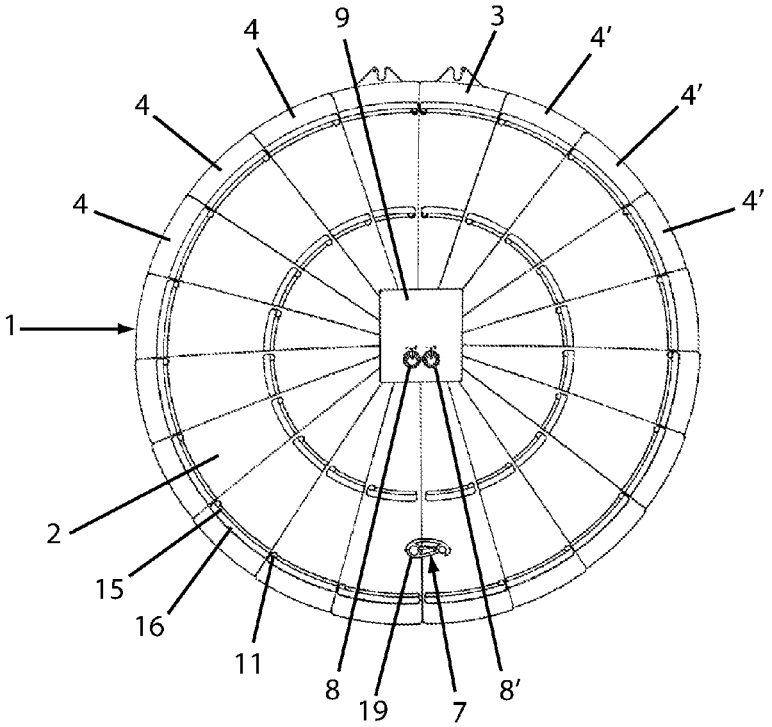
FIG. 3 is a view from the front of the shield in FIG. 1 in deployed position.
Figure 4:
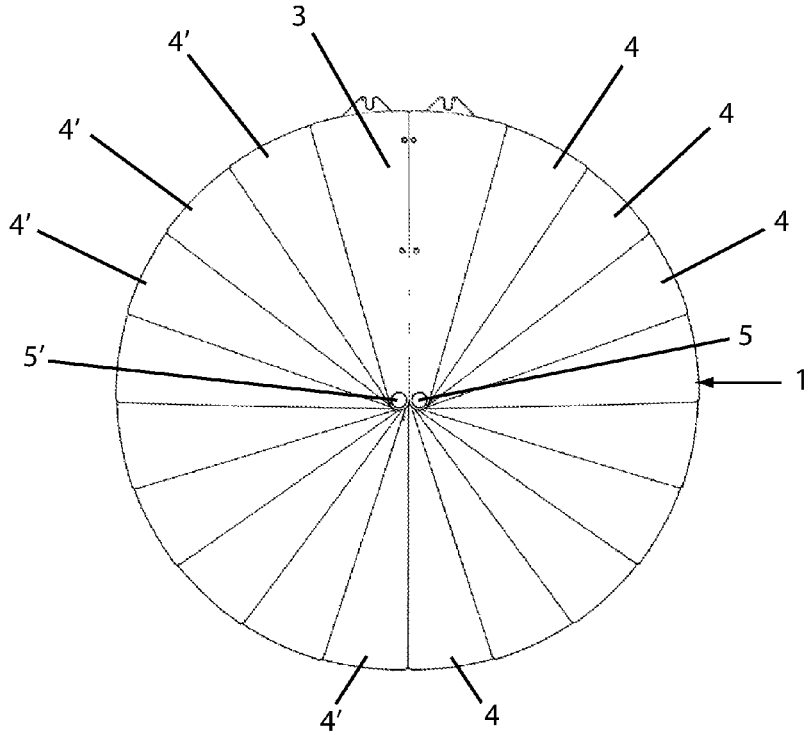
FIG. 4 is a view from the rear of the shield in FIGS. 1 and 2 in deployed position.
Figure 5:
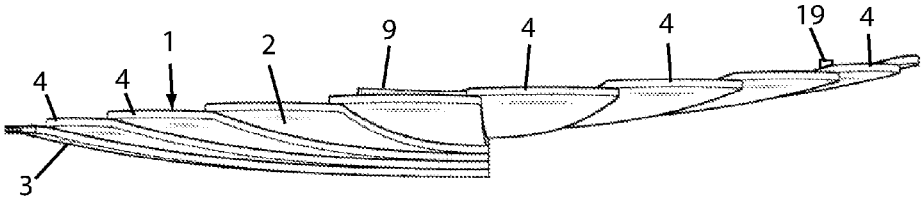
FIG. 5 is a lateral view of the shield along the line V-V in FIG. 4.
Figure 6:
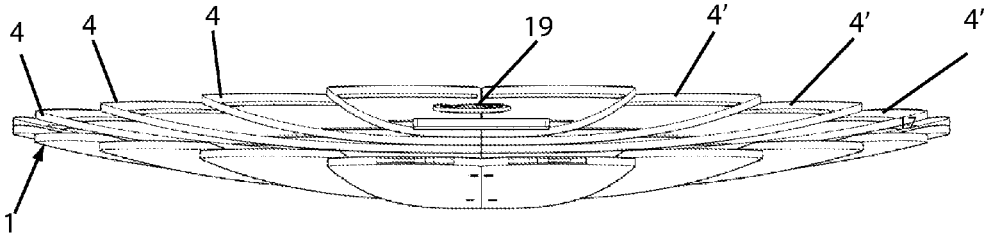
FIG. 6 is a lateral view of the shield along the line VI-VI in FIG. 3.
Figure 7:
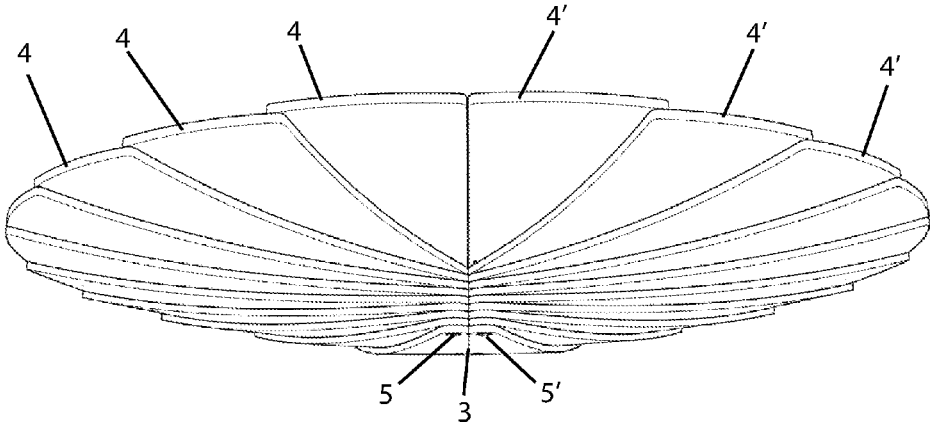
FIG. 7 is a perspective view of the shield in deployed position, viewed obliquely from the rear.
Figure 8:
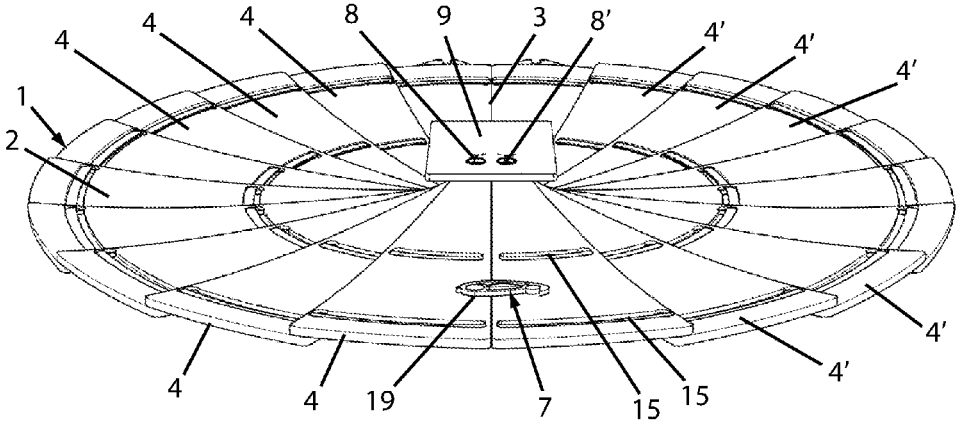
FIG. 8 is a perspective view of the shield in deployed position, viewed obliquely from the front.
Figure 9:
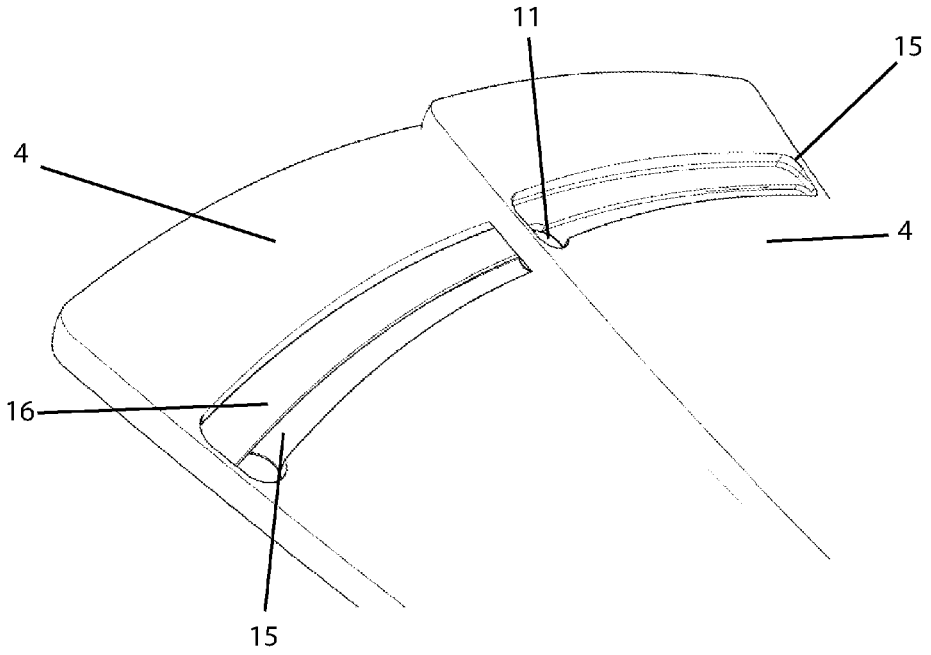
FIG. 9 is a perspective view, showing a portion of two shield plates adjacent to each other, and a device that allows relative pivoting of the shield plates in their respective planes but prevents relative movement in a direction perpendicular to these planes.
Figure 10:
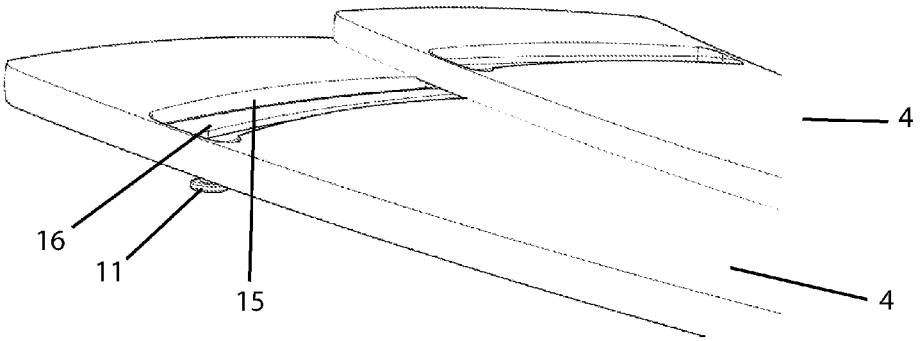
FIG. 10 is a perspective view, showing the same portion as FIG. 9, but viewed from another angle.

As is best evident from FIG. 1, according to the invention, the shield plates 4, 4' are arranged in two stacks 6, 6', disposed next to each other on the base plate, with a respective pivot 5, 5', shown in FIG. 2, for mounting and pivoting of the shield plates 4, 4'. The shield plates 4 in one stack 6 are deployed by pivoting in a first direction and those in the other stack 6' by pivoting in the opposite direction. The uppermost shield plate 4 in one stack 6 and the uppermost shield plate 4' in the other stack 6' are located in a common plane, and connecting devices 7 are provided for connecting these two shield plates 4, 4' edge-to-edge.

In the shown embodiment, also the base plate 3 is substantially triangular and it is of the same size and shape as the shape formed by the two lowermost shield plates 4, 4' lying next to each other in the two stacks 6, 6'. Accordingly, the base plate 3 with the stacks 6, 6' of shield plates 4, 4 has a narrow end and a wide end, and when strapping the folded shield 1 to the arm, the narrow end should be closest to the wrist and the wide end closest to the elbow. In the shown embodiment, each stack 6, 6' comprises nine shield plates 4, 4', wherein said top angle $\alpha$ is 18°. Naturally, the top angle $\alpha$ can be larger or smaller, if so desired, but a smaller top angle $\alpha$ requires more shield plates in each stack and thus results in the disadvantage of an increased height outwardly from the arm of the person carrying the shield, whereas a larger top angle $\alpha$ results in the disadvantage of an increased width outwardly from the arm, which is the reason why a top angle $\alpha$ of 18° is preferable.

In the embodiment shown in FIG. 2, the pivots 5, 5' are formed by head screws, extending through the base plate and a respective stack 6, 6' of shield plates, and a self-locking nut 8, 8' on each screw 5, 5'. In the embodiment shown in FIGS. 3, 5, 8 and 13, the screw and nut assembly also holds a substantially square plate 9 on top of the stacks 6, 6'. If so desired, such a plate 9 can be used for attaching a not shown protective housing for a camera and/or film camera, which can be operated by the person carrying the shield for documenting the situation in question.

The base 3, and each shield plate 4, 4' on top thereof in each stack 6, 6', is connected to the next shield plate 4, 4' by means a device 10 that allows relative pivoting of the shield plates 4, 4' in their respective planes but prevents relative movement in a direction perpendicular to these planes. In the shown embodiment, this device 10 comprises a projecting plug 11 disposed in each shield plate 4, 4', and an arc-shaped groove 15, disposed in each adjacent shield plate 4, 4' in the stack 6, 6' and in the base plate 3, respectively, for receiving the projecting end of the plug 11. The projecting end and the groove 15 are so designed in relation to each other that the plug 11 is form-fittingly connected to the groove 15, and the ends of the groove are closed, so that the shield plates 4, 4' have side edge areas overlapping each other also when they are pivoted away from each other to a maximum extent.

Figure 11:
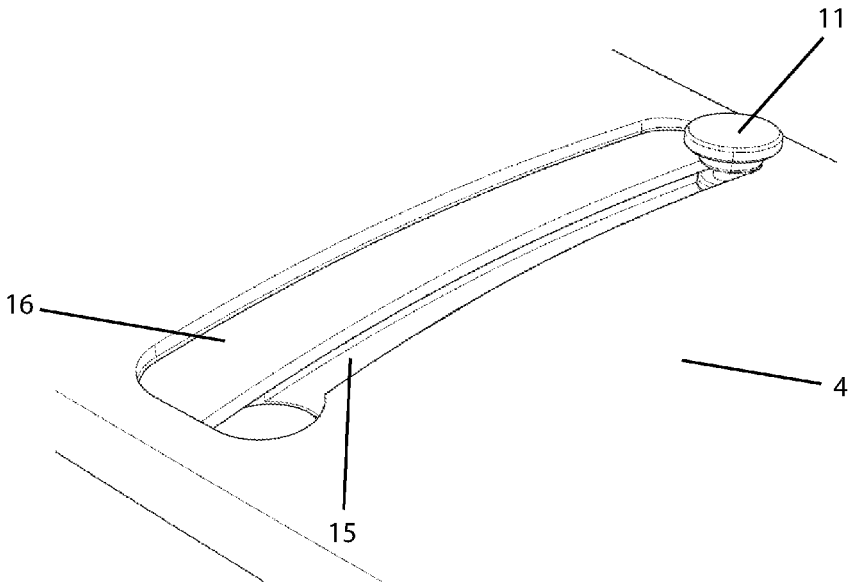
FIG. 11 is a perspective view, showing that the device in FIG. 9 comprises guide grooves in a shield plate a shield plate with grooves for a plug preventing the shield plates from being separated.
Figure 12:
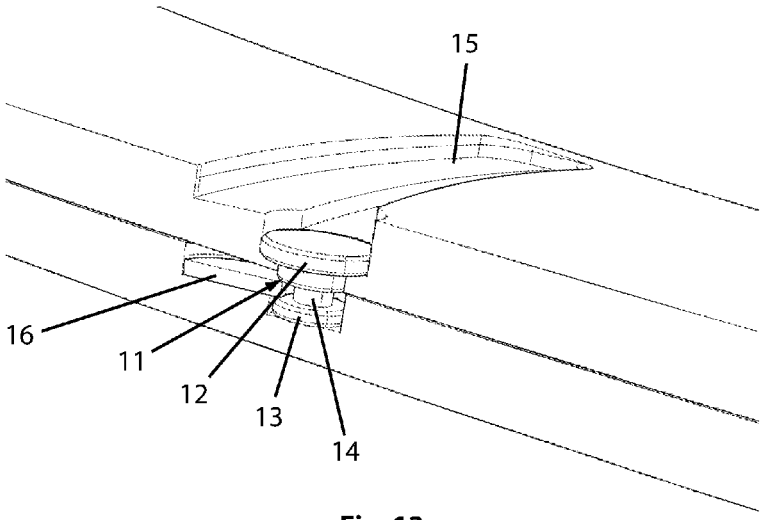
FIG. 12 is a cross-sectional view, showing an upper shield plate provided with the plug in FIG. 11, said plug projecting into the guide groove in the lower shield plate and being capable of moving in the groove but not of leaving it.

As is best shown in FIGS. 11 and 12, such a plug 11 has a head 12, attached in one end of the groove 15 in one shield plate 4, 4', and a portion (13, 14) projecting from the shield plate 4, 4', which extends into the groove 15 in the adjacent shield plate 4, 4' and comprises a foot 13 and a narrower neck portion 14, connecting the head 12 and the foot 13. In order to prevent the plug 11 from leaving the groove 15, the upper portion of the groove (relative to the height direction of the stack) is narrowed and the groove 15 is closed at both ends. In the shown embodiment, the narrowing is formed by a bar 16, suitably of metal such as e.g. brass or copper, which is attached along one groove edge and extends over part of the groove width and into the recess in the plug 11 forming the neck portion 14. Such a bar 16 can be countersunk into the shield plate 4, 4' and anchored thereto e.g. by means of gluing. In order to reinforce the material of the shield plate 4, 4', the bar 16 can extend around part of the groove end, at least at the groove end stopping the plug 11 when deploying the shield 1. In order to increase the stability of the shield 1 against weapons and thrown objects, it is suitable, as shown in FIGS. 1, 13 and 14, that such a groove 15 and plug 11 assembly is present not only close to the outer edge of the shield 1, but that there is also a similar one closer inward toward the pivot axes 5, 5' of the shield plates 4, 4'.

Figure 13:
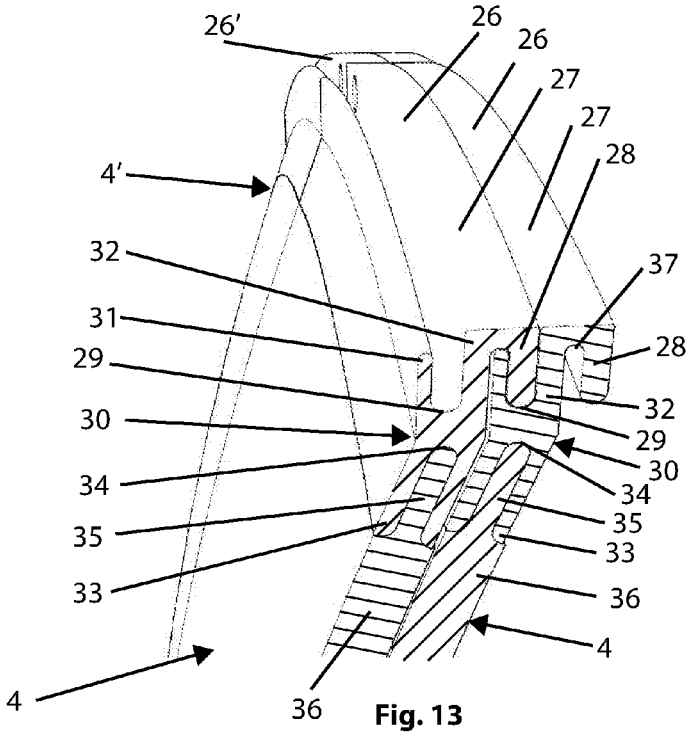
FIG. 13 is a cross-sectional view in perspective, showing a portion of the outside of the shield with two shield plates adjacent to each other in a stack, and an alternative device that allows relative pivoting of the shield plates in their respective planes but prevents relative movement in a direction perpendicular to these planes.
Figure 14:
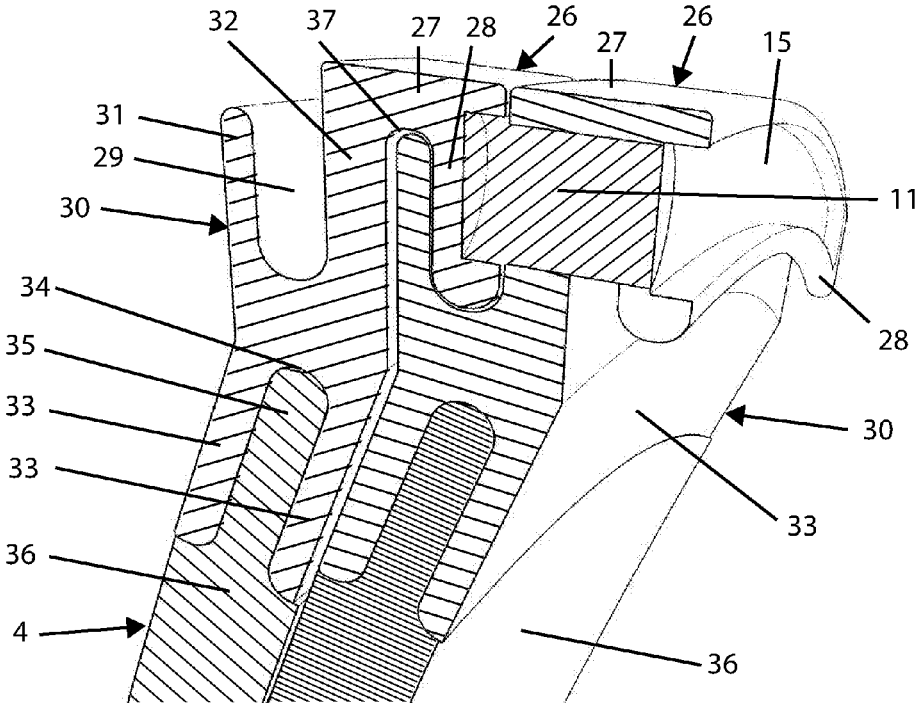
FIG. 14 shows the same view as FIG. 13, but from another angle.

As is shown in FIGS. 13 and 14, the device 10 can, alternatively or in addition, be designed such that each shield plate 4, 4' has an outer end 26, 26' relative to the associated pivot 5, 5'. Together with an outer end of the base plate 3 located simultaneously, these outer ends 26, 26' form a periphery of the shield in deployed position. The device 10 comprises an axially projecting flange 27, disposed on each outer end 26, 26' of the shield plates 4, 4' and having a free end 28, which is folded substantially radially inward. The device 10 further comprises a groove 29, extending along the entire said end of at least all the shield plates 4, 4' in each stack 6, 6' except the uppermost shield plate in the respective stack and in said end of the base plate 3, for receiving the substantially radially inwardly folded end 28 of the flange 27 in an adjacent shield plate 4, 4' while forming a tongue and groove connection. The tongue and groove connection allows pivoting of the shield plates 4, 4' in their respective planes and constitutes a stronger obstacle to relative movement in a direction perpendicular to these planes and thereby increases the stability of the shield edge against attacks with weapons or thrown objects.

In order to further increase the stability of the shield edge against attacks with weapons or thrown objects, it is suitable that the substantially radially inwardly folded end 28 of the flange 27, and the groove 29 for receiving it, are slightly angled such that they are located in a concave plane when viewed in a direction toward a person carrying the deployed shield strapped to the arm. Thereby the risk of the tongue and groove connection being deformed to such an extent in an attack with weapons or thrown objects that the substantially radially inwardly folded end 28 of the flange 27 could be disengaged from its engagement with the groove 29 is reduced.

Preferably, each shield plate 4, 4' comprises a profile strip 30, having a substantially H shaped cross-section, attached to said outer end, wherein the H 30 has two upwardly extended arms 31, 32 delimiting between themselves said groove 29, wherein one arm 32 of the H 30 is slightly elongated upward and then folded to the side and finally folded down for the formation of the inwardly folded end 28 of the flange 27, on the one hand, and a radially inwardly open groove 37 delimited between the upwardly extended portion of the arm 32 and the downwardly folded flange end 28, on the other hand, for receiving the arm 31 in an adjacent shield plate. The H 30 further has two legs 33 forming between themselves a second groove 34, for receiving an end portion 35, tapered on both sides, of a plate-shaped portion 36 of the shield plate 4, 4' itself while forming a tongue and groove connection. By using such a profile strip 30, which is attached to the outer end of the shield plate, the manufacture of the shield plate 4, 4' is simplified as compared to if the shield plate with flange 27, radially inwardly folded free flange end 28 and groove 29 would be made in one piece. The H shaped profile strip 30 and the shield plate 4 with its end portion 35 tapering on both sides are suitably so designed in relation to each other that the outsides of the legs 33 are flush with the respective side of the shield plate 4.

Suitably, the arc-shaped groove 15 for receiving the projecting end of the plug 11 is located in the radially inwardly folded end 28 of the flange 27. When the shield plate 4, 4' is designed with the axially projecting flange 27 and the substantially radially inwardly folded free flange end 28 and the groove 29 for receiving such a flange end in an adjacent shield plate, the plug 11 can be constituted of a cylindrical pin, which does not need to have any retaining function in a direction perpendicular to the planes of the shield plates 4, 4', since the retaining function has been taken over by the flange end 28 in a shield plate and the interacting groove 29 in an adjacent shield plate. It is furthermore suitable that said one arm 32 of the H 30, which is slightly elongated upward and then folded to the side and finally folded down for the formation of the radially inwardly folded end 28 of the flange 27, is thickened compared to the other arm 31 of the H 30.

In order to further increase the stability of the shield 1 against weapons and thrown objects, it is further suitable that the shield surface 2 is concave or convex when viewed in a direction toward a person carrying the deployed shield strapped to the arm. As used herein, the terms "concave" and "convex" also include "funnel-shaped" and "cone-shaped" (also "truncated cone-shaped"), respectively. In order to achieve the desired shape of the shield surface 2, the shield plates 4, 4' can be slightly curved longitudinally, as is best shown in FIGS. 5-8 and 16, i.e. in a direction away from the top angle $\alpha$, so that the deployed shield surface 2 becomes concave. As is evident from FIG. 2, also the base plate 3 has a corresponding concave shape. Even if not shown, it is appreciated that the curvature longitudinally of the shield plates 4, 4' can also be such that the deployed shield surface 2 becomes convex. Alternatively, in a not shown embodiment, the shield plates 4, 4' in each stack 6, 6' can have a top angle portion which is perpendicular to the pivot 5, 5' and a flat portion outside thereof forming an angle smaller than or larger than 90° with the respective pivot 5, 5', so that the deployed shield surface 2 becomes funnel-shaped or (truncated) cone-shaped.

Figure 15:
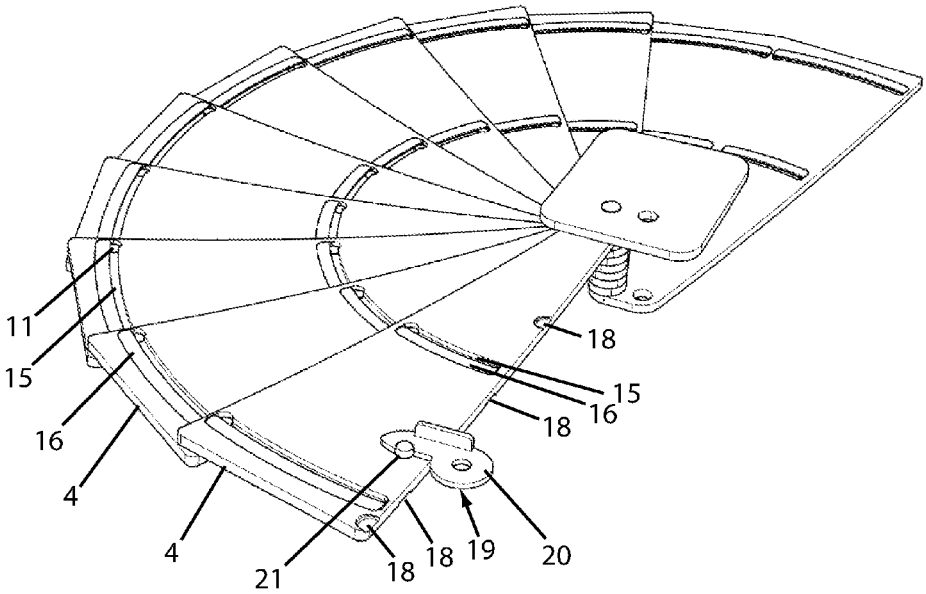
FIG. 15 is a perspective view, showing the uppermost shield plate in one of the stacks opened out to its end position, where it is locked to the opened out uppermost shield plate in the other stack, and aligning means for aligning the shield plates edge-to-edge, and a catch mechanism for achieving the locking.
Figure 16:
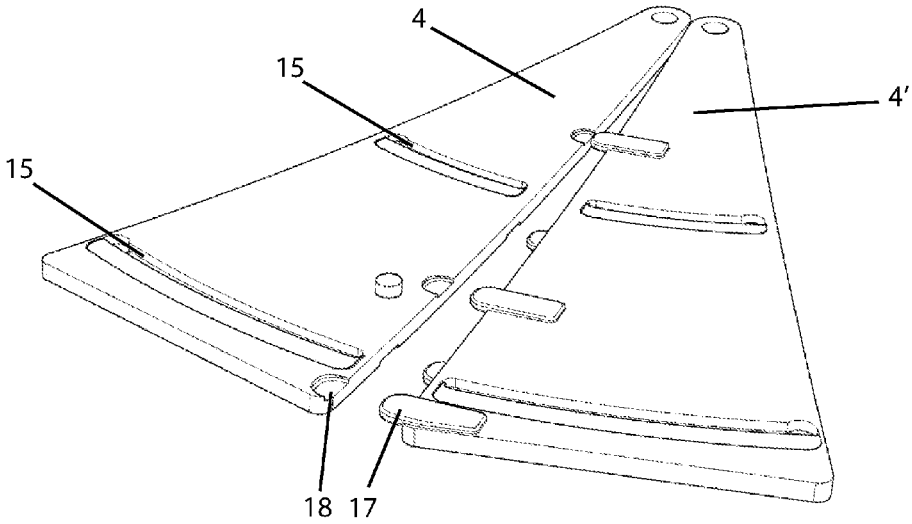
FIG. 16 is a perspective view of the uppermost shield plate in each stack in a position immediately before they abut edge-to-edge when the pivoting has been completed, and showing an alternative design of the aligning means in FIG. 15.

The connecting devices 7 comprise protrusions 17 disposed along the edge of the uppermost shield plate 4' in one stack 6', and recesses 18, corresponding to the protrusions 17, disposed along the edge of the uppermost shield plate 4 in the other stack 6. The protrusions 17 and the recesses 18 ensure that the two shield plates 4, 4' lying edge to edge remain in their common plane also when the shield 1 is subjected to attacks with weapons or thrown objects. As is shown in FIG. 15, such protrusions can comprise pins 17, disposed on the narrow side-edge of at least one of the two shield plates 4, 4' lying edge-to-edge, and recesses (not shown) corresponding to these pins 17 in the adjacent narrow side-edge of the other one of the two shield plates 4, 4'. However, in order to provide a more reliable alignment of the two shield plates 4, 4' narrow side edge-to-narrow side edge, the embodiment shown in FIGS. 1 and 16 is preferable. In this embodiment, the protrusions have the shape of small plates 17 and are disposed on both top side and bottom side of at least one of the two shield plates 4, 4' for aligning the other shield plate 4', 4 with the recesses 18 into a position where the protrusions 17 enter the recesses 18.

The connecting devices 7 further comprise a snap locking means 19, which locks the uppermost shield plate 4' in one stack 6' to the uppermost shield plate 4 in the other stack 6, when they meet each other when deploying the shield 1. In the embodiment shown in FIGS. 1 and 15, the snap locking means 19 is constituted of a spring-loaded catch lever 20, disposed on one of the two shield plates 4, 4', and a shoulder 21, disposed on the other shield plate 4', 4, which the lever 20 can engage. However, if so desired, other snap locking means well known to the skilled person can be used for achieving the desired locking of the two shield plates 4, 4' edge-to-edge.

Figure 17:
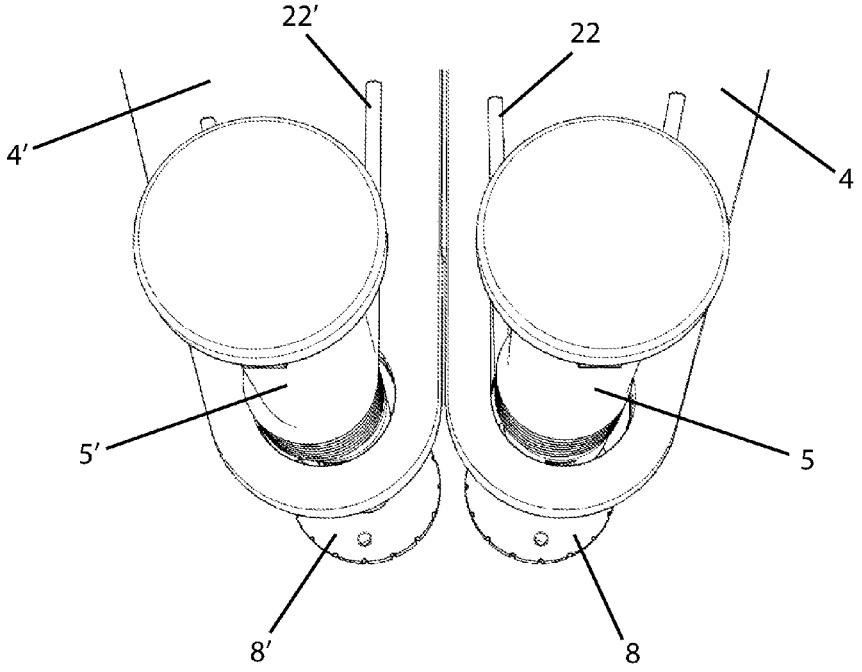
FIG. 17 is a view from the front, showing the pivot portion of the two uppermost shield plates, one from each stack, when springs have pivoted the shield plates away from the respective stack for the formation of a deployed shield surface.

The shield plates 4, 4' in the two stacks 6, 6' can be pivoted out manually in order to form the deployed shield 1. However, in order to enable a rapid deployment of the shield 1, the shield plates 4, 4' in each stack 6, 6' are preferably spring-loaded by spring devices 22, as shown in FIG. 17, so that by actuating a release device 23, when needed, they can be pivoted to the deployed position rapidly by the spring force. In the shown embodiment, the spring devices are constituted of a screw line-shaped torsion spring 22, 22' for each stack 6, 6', and the torsion springs 22 have opposite winding directions, enclose the respective pivot 5, 5' and have one of their ends attached to the base plate 3 and the other one to a respective uppermost shield plate 4, 4' in the respective stack 6, 6'. Some control of the speed when opening out the shield plates 4, 4' from the stacks 6, 6' for achieving a deployed shield 1 can be obtained by fastening or releasing the self-locking nuts 8, 8' slightly. Naturally, if so desired, other spring devices can also be used, e.g. not shown gas springs.

Figure 18:
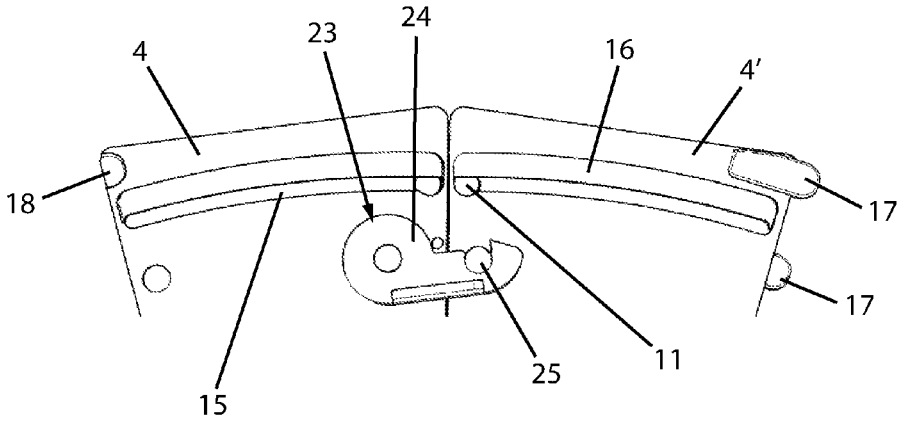
FIG. 18 is a view from the front of a portion of the shield in folded position, showing a release device, which allows the spring force to pivot the shield plates away from the respective stack for the formation of a deployed shield surface.

In the embodiment shown in FIG. 18, the release device 23 comprises a catch lever 24 and a shoulder 25 for engagement by the catch lever. The catch lever 24 is located on the uppermost shield plate 4' in one stack 6', next to a side edge adjacent to the uppermost shield plate 4 in the other stack 6 and close to the intended periphery of the shield 1, whereas the shoulder 25 is positioned accordingly on the uppermost shield plate 4 in the other stack 6. Naturally, if so desired, other locking/release devices 23 can also be used to enable a spring-loaded rapid deployment of the shield 1 when needed.

In one embodiment, the shield plates 4, 4' consist of an impact resistant, transparent plastic material, such as polycarbonate, suitably having a thickness of approx. 4 mm. Of course, both thinner and thicker shield plates 4, 4' can be used, but, as a rule, 4 mm provides satisfactory protection in regular missions, without causing the stacks 6, 6' to become so high that the shield 1 in folded position on the arm becomes so heavy and awkward that it is more of a hindrance than a help to the person carrying it attached to the arm. In some cases, it may be required that the shield plates 4, 4' are reinforced with not shown bullet-proofing fabric in order to become bullet-proof. The filaments in such a fabric can e.g. consist of poly-paraphenylene terephtalamide, such as Kevlar®, or gel-spun polyethylene of high molecular weight, usually between 2 and 6 million, known under the product names Dyneema and Spectra. It is also conceivable to reinforce the shield with graphene. The profile strips 30, when used, suitably consist of the same material as the rest of the shield, and are preferably attached to the outer ends 26 of the shield plates 4, 4' with a suitable adhesive, e.g. of epoxy type.

If all shield plates 4, 4' are identical to each other, which is preferable from a manufacturing point of view, the shield 1 gets a substantially circular shape in deployed position. If so desired, it is also possible, but not shown, to design the shield plates 4, 4' so as to give the deployed shield surface 2 a shape which deviates from a purely circular shape, e.g. a substantially oval shape. This can, for example, be achieved in that the shield plates 4, 4' in the middle of each stack 6, 6' are made with a successively longer length than the other ones in order to provide an oval shield 1 with a greater height than width and thereby an improved protection vertically for the carrier of the shield. In order to thereby avoid that the shield 1 in deployed position gets a serrated periphery, the shield plates 4, 4' can be made such that their side edges are of different lengths.

INDUSTRIAL APPLICATION

The deployable and foldable shield is intended to be used by police officers and persons in similar professions in missions where they might need to protect themselves against weapons and thrown objects.

The invention claimed is:

1. A deployable and foldable shield, comprising an elongated base plate having attachment means for attaching the base plate along the forearm of a person, and a plurality of substantially triangular and at least substantially equal-sided shield plates, supported by the base plate, which have a top angle (α) smaller than 40° and are pivotally mounted at a triangle corner enclosing the top angle (α) to a pivot projecting from the base plate, said shield plates forming a stack supported by the base plate when the shield is folded and forming a deployed shield surface supported by the base plate when pivoted away from the base plate, wherein the shield plates are arranged in two stacks, disposed next to each other on the base plate, with a respective pivot for mounting and pivoting of the shield plates, that the shield plates in one stack are deployed by pivoting in a first direction and the shield plates in the other stack by pivoting in the opposite direction, and that connecting devices are provided for connecting these uppermost two shield plates.

2. The shield according to claim 1, wherein the uppermost shield plate in one stack and the uppermost shield plate in the other stack are located in a common plane, and that the connecting devices are adapted to connect two said uppermost shield plates edge-to-edge.

3. The shield according to claim 1, wherein the base plate and each shield plate on top thereof in each stack is connected to the next shield plate by means a device that allows relative pivoting of the shield plates in their respective planes but prevents relative movement in a direction perpendicular to these planes.

4. The shield according to claim 3, wherein the device comprises a projecting plug disposed in each shield plate, and an arc-shaped groove, disposed in each adjacent shield plate in the stack and in the base plate, respectively, for receiving the projecting end of the plug, wherein the projecting end and the groove are so designed in relation to each other that the plug is form-fittingly connected to the groove, and the ends of the groove are closed, so that the shield plates have side edge areas overlapping each other also when they are pivoted away from each other to a maximum extent.

5. The shield according to claim 4, wherein each shield plate has an outer end relative to the associated pivot, said outer ends forming together with an outer end of the base plate located simultaneously a periphery of the shield in deployed position, and that the device comprises an axially projecting flange, disposed on each outer end of the shield plates and having a free end which is folded substantially radially inward, and that the device further comprises a groove, extending along the entire said end of at least all the shield plates in each stack except the uppermost shield plate in the respective stack, and in said end of the base plate, for receiving the substantially radially inwardly folded end of the flange in an adjacent shield plate while forming a tongue and groove connection, which allows pivoting of the shield plates in their respective planes and constitutes a stronger obstacle to relative movement in a direction perpendicular to these planes.

6. The shield according to claim 5, wherein the substantially radially inwardly folded end of the flange, and the groove for receiving it, are slightly angled such that they are located in a concave plane when viewed in a direction toward a person carrying the deployed shield strapped to the arm.

7. The shield according to claim 5, wherein each shield plate comprises a profile strip, having a substantially H-shaped cross-section, attached to said outer end, wherein the H has two upwardly extended arms delimiting between themselves said groove, wherein one arm of the H is slightly elongated upward and then folded to the side and finally folded down for the formation of the inwardly folded end of the flange, and wherein the H has two legs forming between themselves a second groove for receiving an end portion, tapered on both sides, of a plate-shaped portion of the shield plate itself while forming a tongue and groove connection.

8. The shield according to claim 5, wherein the arc-shaped groove for receiving the projecting end of the plug is located in the radially inwardly folded end of the flange.

9. The shield according to claim 7, wherein said one arm of the H, which is slightly elongated upward and then folded to the side and finally folded down for the formation of the inwardly folded end of the flange, is thickened compared to the other arm of the H.

10. The shield according to claim 1, wherein the shield surface is concave or convex when viewed in a direction toward a person carrying the deployed shield strapped to the arm.

11. The shield according to claim 10, wherein the shield plates are slightly curved longitudinally, i.e., in a direction away from the top angle (α), so that the deployed shield surface becomes concave or convex.

12. The shield according to claim 10, wherein the shield plates in each stack form an angle smaller than 90° with the respective pivot, so that the deployed shield surface becomes funnel-shaped or cone-shaped.

13. The shield according to claim 1, wherein the connecting devices comprise protrusions disposed along the edge of the uppermost shield plate in one stack, and recesses, corresponding to the protrusions, disposed along the edge of the uppermost shield plate in the other stack.

14. The shield according to claim 13, wherein the protrusions are disposed on both top side and bottom side of the shield plate for aligning the shield plate with the recesses into a position where the protrusions enter the recesses.

15. The shield according to claim 13, wherein the connecting devices comprise a snap locking means, which locks the uppermost shield plate in one stack to the uppermost shield plate in the other stack when they meet each other when deploying the shield.

16. The shield according to claim 1, wherein the shield in folded position has the shield plates spring-loaded so that by actuating a release device, when needed, they can pivoted to the deployed position rapidly by the spring force.

17. The shield according to claim 1, wherein the shield plates consist of transparent material, preferably polycarbonate.

18. The shield according to claim 1, wherein the shield plates are reinforced with bullet-proofing fabric in order to become bullet-proof.

19. The shield according to claim 1, wherein the shield plates are designed so as to give the deployed shield surface a shape which deviates from a purely circular shape.

* * * * *